US005432294A

United States Patent [19]

Falzarano, Jr.

[11] Patent Number: 5,432,294

[45] Date of Patent: Jul. 11, 1995

[54] ELECTRONIC BELL TONE GENERATOR

[75] Inventor: Bart Falzarano, Jr., Forked River, N.J.

[73] Assignee: Wheelock Inc., Long Branch, N.J.

[21] Appl. No.: 25,965

[22] Filed: Mar. 3, 1993

[51] Int. Cl.[6] ..... G10H 57/10; G10H 7/00

[52] U.S. Cl. ..... 84/609; 84/624; 84/649; 84/694

[58] Field of Search ..... 84/609–614, 84/624, 627, 649–652, 659, 663, 694, 702, 703

[56] References Cited

U.S. PATENT DOCUMENTS

| | | | |
|---|---|---|---|
| 4,183,278 | 1/1980 | Rea et al. | 84/694 |
| 4,250,787 | 2/1981 | Segan et al. | 84/609 |
| 4,290,334 | 9/1981 | Kramer | 84/702 |
| 4,373,416 | 2/1983 | Endo et al. . | |
| 4,953,437 | 9/1990 | Starkey . | |
| 5,208,414 | 5/1993 | Yamada | 84/627 |

*Primary Examiner*—Stanley J. Witkowski

*Attorney, Agent, or Firm*—Brumbaugh, Graves, Donohue & Raymond

[57] ABSTRACT

A microprocessor provides a pulse width modulated pulse train at a predetermined frequency to a tuned resonant circuit having a transducer element. The first pulse has a predetermined width. The pulse widths of successive pulses are decreased in a predetermined manner until the pulse width reaches a minimally desired width. The next generated pulse has the first predetermined width and each successive width is decreased in the same predetermined manner. This pattern is generated repeatedly. Each one of these generated patterns produces an audible waveform from the tuned resonant circuit which changes over time. If the pulse train frequency, the pulse width modulation, and the circuit's resonant frequency are chosen correctly, the audible waveform will have the same characteristics as the waveform produced by a specified bell which has been struck.

5 Claims, 3 Drawing Sheets

ELECTRONIC BELL TONE GENERATOR

SPECIFICATION

BACKGROUND OF THE INVENTION

This invention relates generally to electronic sound reproduction and more particularly to bell tone reproduction.

One known approach to digitally generating musical notes is a digital synthesizer which generates musical tones from a sequence of discrete data samples of the desired waveform. Enough samples of the waveform are stored in memory to define the structure of the waveform. The stored samples are then read out in a time sequence according to the pitch of the note selected on the keyboard or other similar device. To improve their sound quality, such synthesizers frequently use an interpolator to fill in the gaps between the sampled points. Additional components are used to perform the envelope shaping after the interpolator has determined the waveform. These systems require a lot of hardware and are not practical to fulfil the needs of a user who merely wants to repeatedly reproduce one type of sound, for example, a bell tone.

A bell tone is often desirable in alarm or warning systems. In general, the striking of a bell produces a sound, and thus a waveform, which changes over time. At the instant of the striking of a bell, a "strike frequency" is heard. As time progresses one or more "overtones," which are lower frequencies than the strike frequency, are heard over the strike frequency. Finally the bell will vibrate at its "resonant frequency," one that is lower than the overtone(s), until the next strike or until the bell loses its kinetic energy and stops vibrating. At any given time, all of these frequencies, and others which have amplitudes too small to be heard, are present in the bell's complex waveform, but the frequency with the largest amplitude is the one which is heard most prominently by the human ear.

It is an object of this invention to provide a simple electronic bell tone generator.

SUMMARY OF THE INVENTION

According to the present invention, a microprocessor provides a pulse width modulated pulse train at a predetermined frequency to a tuned resonant circuit having a transducer element. The first pulse has a predetermined width. The pulse widths of successive pulses are decreased periodically in a predetermined manner until the pulse width reaches a minimally desired width. The next generated pulse has the first predetermined width and each successive width is decreased in the same predetermined manner. This pattern is generated repeatedly. Each one of these generated patterns produces an audible waveform from the tuned resonant circuit which changes over time. The pulse train frequency, the pulse width modulation and the circuit's resonant frequency can be chosen such that the tone produced by the tuned circuit simulates a specified bell tone.

BRIEF DESCRIPTION OF THE DRAWINGS

Other objects, features and advantages of the invention will become apparent, and its construction and operation better understood, from the following detailed description when read in conjunction with the accompanying drawings, in which:

FIG. 1(*b*) is a schematic drawing of a second embodiment of the present invention;

FIG. 3(*b*) shows a low duty cycle pulse train input and the resulting complex waveform which is produced in accordance with the present invention;

DESCRIPTION OF THE EMBODIMENTS

A transducer element such as a capacitive piezoelectric element or an inductive voice coil can act in a tuned resonant circuit to produce sound from an applied electric current. Application of a sinusoidal wave form to a transducer element in a tuned resonant circuit will cause the element to vibrate at the applied wave frequency, thus producing a tone. However, the strength of the vibration depends on the strength of the signal and how close the applied frequency is to the resonant frequency of the circuit. The element will, of course, vibrate at its greatest amplitude, or sound pressure level, when the circuit's resonant frequency is applied. If the applied waveform is a pulse, the filtering effect of the tuned circuit will result in a complex waveform, comprised of several of the frequencies in the Fourier series which makes up the pulse waveform, emanating from the transducing element. The sinusoidal component of this waveform with the highest amplitude will be heard most prominently. Using these basic premises, the present invention simplifies the task of reproducing a bell tone, which itself is a complex waveform, comprised of several frequencies, which changes over time.

Figure 4:
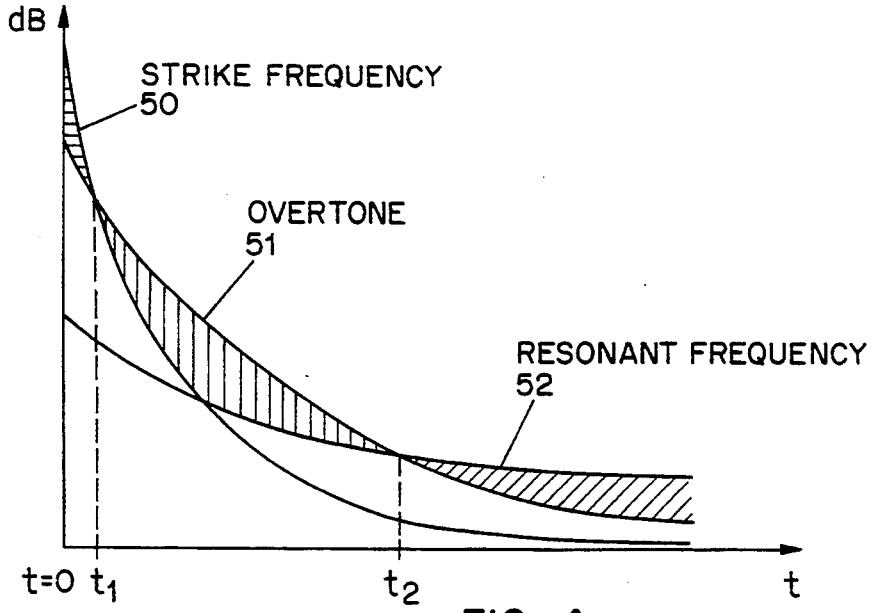
FIG. 4 is a sound pressure v. time graphical depiction of three frequencies which comprise the complex waveform produced by a typical bell strike.

FIG. 4 is a graph depicting the signal strength, or sound pressure level, in dB, v. time characteristics of a typical bell tone. For simplicity, only three frequencies are depicted in the graph. These may be thought of as the three frequency components with the highest sound pressure levels in the complex waveform produced by the bell. The relative sound pressure levels of the frequencies change as time progresses. The shaded areas indicate the difference in sound pressure level between the frequency with the highest sound pressure level and the frequency with the next highest sound pressure level at any given time. At $t=0$, the strike frequency 50 is the loudest of the three frequencies. At $t=t_1$, the second frequency, called the overtone 51, a lower frequency, becomes heard over the strike frequency 50. At $t=t_2$, the third frequency, called the resonant frequency 52, an even lower frequency, becomes most prominent and remains so until the next strike or until the bell ceases to vibrate. Applying a pulse width modulated signal at a fixed frequency to a tuned resonant circuit can produce the same result if the pulse widths are modulated in a particular manner which is explained in detail hereinbelow.

Figure 1A:
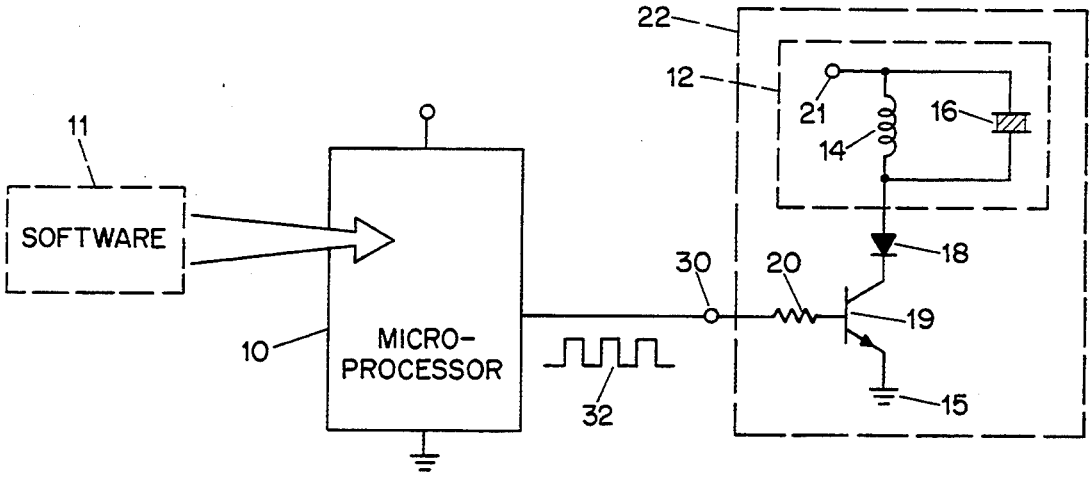
FIG. 1(*a*) is a schematic drawing of a first embodiment of the present invention.
Figure 1B:
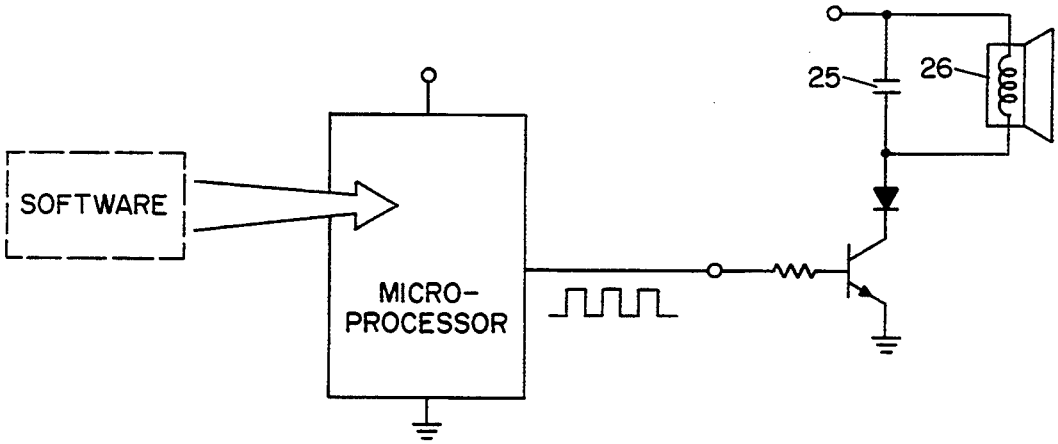

Turning now to FIG. 1(*a*), which is a schematic drawing of one embodiment of the present invention, a microprocessor 10, which is programmed to output a pulse width modulated signal 32, and a simple electrical circuit 22 are all that are needed to produce a bell tone. The software 11 within the microprocessor 10 can be written so as to produce the desired pulse width modulated signal 32. The pulse train 32 is applied at node 30 to a tuned resonant circuit 12 through a resistor 19, a transistor 10 and a diode 18. The tuned resonant circuit 12 is comprised of an inductor 14 and a piezoelectric capacitive element 16. An alternative embodiment is shown in FIG. 1(*b*) in which a capacitor 25 and an inductive voice coil 26 are used in the sound-producing tuned resonant circuit 12. All other components of the invention are the same as in FIG. 1(*a*) and therefore are not numbered. The values of the inductive and capacitive elements in both embodiments are chosen to induce the circuit 22 to resonate at particular frequencies, explained hereinbelow, when a pulse width modulated signal is applied.

The circuit 22 is powered by a voltage source at node 21, typically 12 V or 24 V. The pulse train is typically 0 V to 5 V. When the pulse train 32 is applied, through the resistor 20, the transistor 19 turns on when the signal is 5 V and turns off when the signal is 0 V. When the transistor is on, current from the circuit voltage source flows from node 21 through the tuned circuit 12, the diode 18 and the transistor 19 to ground 15 thus storing energy in the tuned circuit 12 during this on time. When the transistor is off, no significant current flows through the diode 18 or transistor 19, and the stored energy gradually discharges in the tuned circuit 12. Thus, the tuned circuit 12 receives a pulse train having the characteristics of the input pulse train 32, albeit at a higher voltage.

Figure 2:
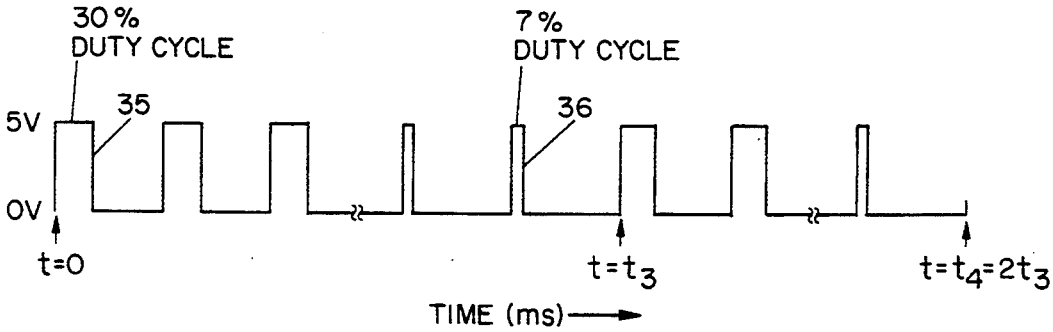
FIG. 2 is an example of a pulse width modulated signal which is generated by the microprocessor of FIGS. 1(*a*) and 1(*b*)

The pulse train of FIG. 2 is typical of the pulse train 32 which is applied to the resonant circuit accordance with the present invention. The first pulse 35 occuring at $t=0$ has a high duty cycle, typically 30%. Subsequent pulse widths are decreased by a predetermined function of the previous pulse width until a pulse 36 having a minimum duty cycle, typically 7% occurs at $t=t_3$, at which time the maximum pulse width is generated again and the decreasing pulse width pattern is repeated. Each one of these generated patterns effectively simulates one bell strike, and the length of time between pulses having the maximum width is called the "sweep cycle." The duty cycle ratios of 30% and 7% have been determined empirically to be effective in reproducing a wide range of bell tones. Simple experimentation, however, may yield a more effective maximum and minimum duty cycle for a particular desired bell tone.

Figure 3A:
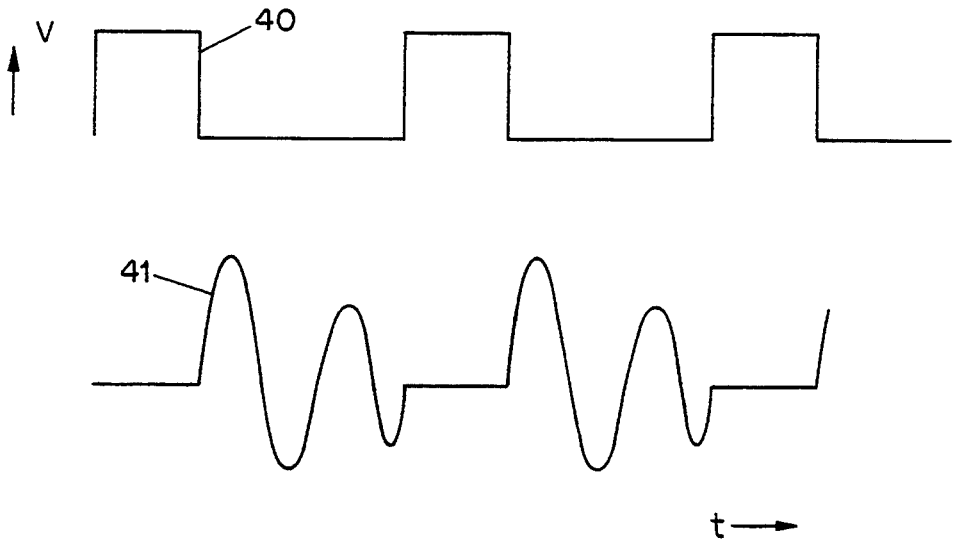
FIG. 3(*a*) shows a high duty cycle pulse train input and the resulting complex waveform which is produced in accordance with the present invention.
Figure 3B:
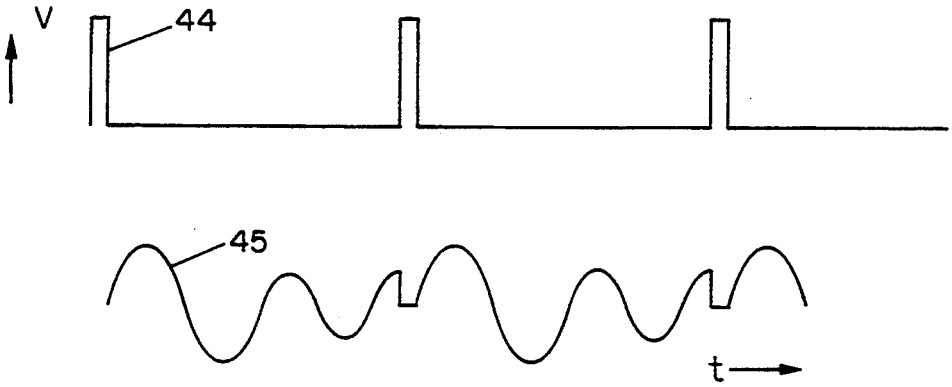

The effect the decreasing duty cycle has on the tuned resonant circuit 12 is significant to the operation of the invention. FIG. 3(*a*) shows an input train of only high duty cycle pulses 40 which is representative of the beginning of each sweep cycle of FIG. 2. When this signal is applied to the circuit 22 of the invention, the tuned resonant circuit waveform 41 will be a complex waveform having higher frequency components at higher amplitudes. This is attributable to the higher amount of energy which is transferred to the tuned circuit 12 by the wide pulse as compared to a pulse which is shorter in duration. A somewhat complex analysis beyond the scope of this disclosure involving the filtering effects of the resonant circuit, as well as the inventor's experimentation, reveals that of these higher frequency components the tuned circuit resonant frequency is the frequency with the highest sound pressure level and thus will be heard by the human ear most prominently.

FIG. 3(*b*) shows an input train of only low duty cycle pulses 44 which is representative of the end of each sweep cycle of FIG. 2. When this signal is applied to the circuit 22 of the invention, the tuned resonant circuit waveform 45 will be a complex waveform having lower frequency components at lower amplitudes. This is due to the relatively low amount of energy transferred to the tuned circuit by the short pulse. Again, a complex analysis beyond the scope of this disclosure, as well as the inventor's experimentation, reveals that at very low duty cycles, the most prominent frequency of the lower frequencies comprising the circuit's complex waveform will be the pulse train frequency. Note that the sound pressure level of this pulse train frequency will be much less than that of the circuit's resonant frequency which is heard when the pulse duty cycle is high.

It follows that if a pulse train such as that shown in FIG. 2 is applied to the circuit 22 of the present invention, the result is a complex waveform which at $t=0$ has as its most prominent frequency the resonant frequency of the tuned circuit, and at a time slightly before $t=t_3$ has as its most prominent frequency the frequency of the input pulse train. Therefores if the input pulse train frequency is matched to the resonant frequency of a particular bell being simulated and the resonant frequency of the tuned circuit is matched to the strike frequency of the bell being simulated, the tuned circuit will respond to the pulse train by emitting a tone which, at least at the beginning and end of the sweep cycle, sounds like the desired bell tone.

However, the similarity to a bell tone is not only at the beginning and end of the sweep cycle. It also happens that another characteristic of the complex waveform produced by a tuned circuit in response to a train of pulses having decreasing pulse widths is that between the time at the beginning of the pulse train when the tuned circuit resonant frequency (the simulated bell strike frequency) is highest in sound pressure level and the time near the end of the pulse train when the pulse train frequency (the simulated resonant frequency) is highest in sound pressure level, one or more other frequencies in the complex waveform will have the highest sound pressure level. This results in a close simulation of the bell overtones which are heard when a bell having a bell strike frequency of the tuned circuit resonant frequency and a bell resonant frequency of the pulse train frequency is struck. Therefore, according to the present invention, by applying a pulse width modulated signal to a tuned resonant circuit having a transducer element, one is able to reproduce a wide variety of bell tones.

Returning now to FIG. 2, $t=t_3$ marks the end of the first sweep cycle and the beginning of the next sweep cycle. At this time, the simulated bell will be "struck" again and the tone which is heard will change abruptly from the bell resonant frequency to the bell strike frequency, and the cycle of audible tones will progress again from strike frequency to overtone(s) to resonant frequency until the next "strike" at $t=t_4$.

To help better understand the invention described herein, consider a particular example of an 8 inch bell shell, with a 66.7 ms sweep cycle; i.e., the bell is struck fifteen times each second. It can be determined from a simple frequency analysis of a bell tone emanating from such a bell that the bell has a strike frequency of 3500 Hz and a resonant frequency of 1560 Hz.

To make the most efficient use of the transducing effect of the piezoelectric element or the voice coil, the tuned circuit resonant frequency should match the transducer element's resonant frequency. Therefore, a transducer element having a resonant frequency equal to the strike frequency of the bell being simulated should be chosen. Using the strike frequency, a transducer element is chosen, here a piezoelectric element of capacitance C, having a resonant frequency of 3500 Hz. The inductor value can be chosen using the formula $$f_{res} = 1/(2\pi\sqrt{LC}).$$

Using the bell resonant frequency, a pulse train frequency of 1560 Hz is selected. The sweep cycle, as stated above, is 66.7 ms. If the maximum duty cycle is 30% and the minimum duty cycle is 7%, a linear duty cycle reduction of approximately 0.34% every 1 ms can be used. This pulse width modulation scheme will yield an overtone frequency of 2500 Hz, which is close to that of the actual 8 inch bell. Those skilled in the art will appreciate that other nonlinear pulse width modulation schemes may be employed to produce bell tones with varying strengths and durations of the different frequencies which are heard.

Figure 5:
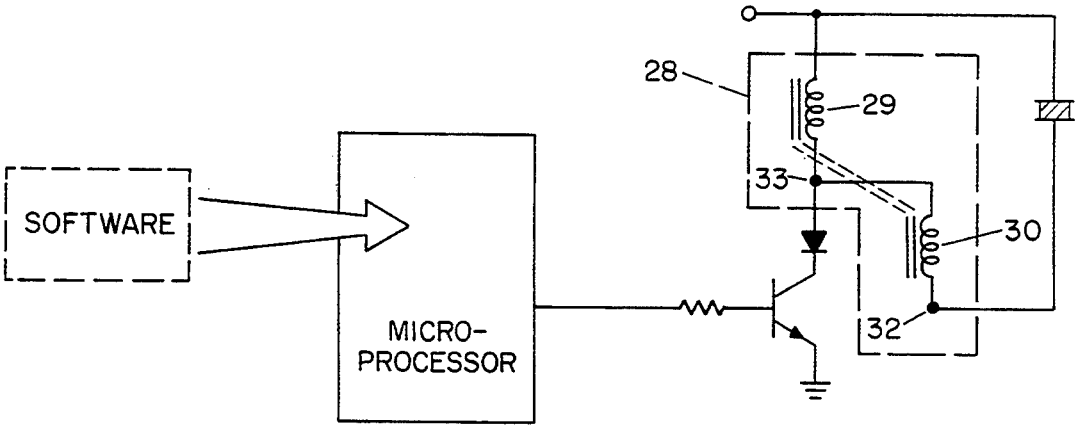
FIG. 5 is a schematic drawing of a third embodiment of the present invention.

In another embodiment of the present invention, depicted in FIG. 5, the inductor 14 of the embodiment depicted in FIG. 1(*a*) is replaced by an auto transformer 28. This element is essentially two electrically coupled inductive elements 29 and 30 in series. This embodiment is useful to create a bell tone generator which may be used with either of two voltages, for example, 12 or 24 V. In this embodiment, if the voltage applied at node 21 is 12 V, the circuit would be connected as shown in FIG. 5, i.e., with the anode of the diode 18 connected to node 33. If the voltage applied at node 21 is instead 24 V, the circuit would be connected with the anode of diode 18 connected to node 32 rather than node 33.

The auto transformer 28 functions to keep the voltage across the piezoelectric element the same regardless of whether the circuit input voltage is 12 or 24 V. This feature enables a user to employ the tone generator in a system which uses one of two voltages, for example 12 or 24 V, as its main voltage. Rather than having a permanent connection between diode 18 and circuit 12, an embodiment of the tone generator which incorporates this feature may have a jumper wire with one end connected to the anode of diode 18. The user connects the other end of the jumper to one of two taps which are connected to nodes 32 and 33, depending on which voltage the user has connected to node 21.

While the above is a description of the invention in its preferred embodiment, various modifications, alternate constructions and equivalents may be employed, only some of which have been described above. Therefore, the above description and illustration should not be taken as limiting the scope of the invention which is defined by the appended claims.

I claim:

1. An apparatus for generating a tone which simulates a bell tone having audible frequencies comprised of a strike frequency, one or more overtones and a resonant frequency, the apparatus comprising;

means for generating pulse width modulated signals at a predetermined frequency, said predetermined frequency corresponding substantially to said bell tone resonant frequency, and said signals including a repeated pattern of pulses, the first pulse of each pattern having a duty cycle of a first predetermined percentage and successive pulse widths being decreased by a predetermined pulse width reduction function until the pulse duty cycle reaches a second predetermined percentage at which time the pattern is repeated, said predetermined pulse width reduction function and said first and second predetermined duty cycle percentages determining said overtones;

a tuned resonant circuit including a transducer which produces an audible output upon application to said circuit of said pulse width modulated signals, said tuned circuit having a resonant frequency corresponding substantially to said bell tone strike frequency; and means for transmitting said pulse width modulated signals to said tuned resonant circuit.

2. The apparatus of claim 1 wherein the means for generating the pulse width modulated signals includes a microprocessor.

3. The apparatus of claim 1 wherein the tuned resonant circuit includes an inductor said transducer comprises and a capacitive piezoelectric element.

4. The apparatus of claim 1 wherein the tuned resonant circuit includes a capacitor and said transducer comprises an inductive voice coil.

5. The apparatus of claim 1 wherein the tuned resonant circuit includes an autotransformer and said transducer comprises a capacitive piezoelectric element.

* * * * *

UNITED STATES PATENT AND TRADEMARK OFFICE

CERTIFICATE OF CORRECTION

PATENT NO. : 5,432,294

DATED : July 11, 1995

INVENTOR(S) : Bart Falzarano, Jr.

It is certified that error appears in the above-indentified patent and that said Letters Patent is hereby corrected as shown below:

Col. 3, line 35, "circuit" should read --circuit 12 in--;
Col. 3, line 36, "occuring" should read --occurring--;
Col. 6, line 41, "said" should read --and said--;
Col. 6, line 42, "and a" should read --a--.

Signed and Sealed this

Twenty-sixth Day of September, 1995

Bruce Lehman

*Attest:*

BRUCE LEHMAN

*Attesting Officer*

*Commissioner of Patents and Trademarks*